United States Patent [19]

Benson

[11] 3,973,820

[45] Aug. 10, 1976

[54] TERMINAL POST CONNECTION ESPECIALLY FOR STORAGE BATTERIES

[75] Inventor: Anders Benson, Stockholm, Sweden

[73] Assignee: Aktiebolaget Tudor, Stockholm, Sweden

[22] Filed: Apr. 23, 1974

[21] Appl. No.: 463,417

[30] Foreign Application Priority Data

Apr. 27, 1973 Sweden ..... 7305940

[52] U.S. Cl. ..... 339/230 R; 339/239

[51] Int. Cl.[2] ..... H01R 11/26

[58] Field of Search ..... 339/229, 230 R, 231, 339/236, 238, 239

[56] References Cited

UNITED STATES PATENTS

| | | | |
|---|---|---|---|
| 2,347,168 | 4/1944 | Beckman | 339/229 |
| 2,493,389 | 1/1950 | Casey | 339/230 R |
| 2,677,812 | 5/1954 | Rieg | 339/238 X |

*Primary Examiner*—Roy Lake
*Assistant Examiner*—E. F. Desmond
*Attorney, Agent, or Firm*—Burns, Doane, Swecker & Mathis

[57] ABSTRACT

A terminal connection device which is especially adapted for use with storage batteries such as are commonly used in vehicles as a starting battery. The connection device has a plastic protective cap mounted for pivotal movement which can be lifted by swinging through an angle to release the connecting device so that it can be removed from the battery terminal post. Sleeves having oppositely directed threads or cam surfaces close the stirrup arms about the terminal post as the cap is lowered to its protective position. A thread bolt serves to adjust the location of the sleeves to compensate for variations in size of the battery terminal posts.

5 Claims, 28 Drawing Figures

FIG. 1
PRIOR ART
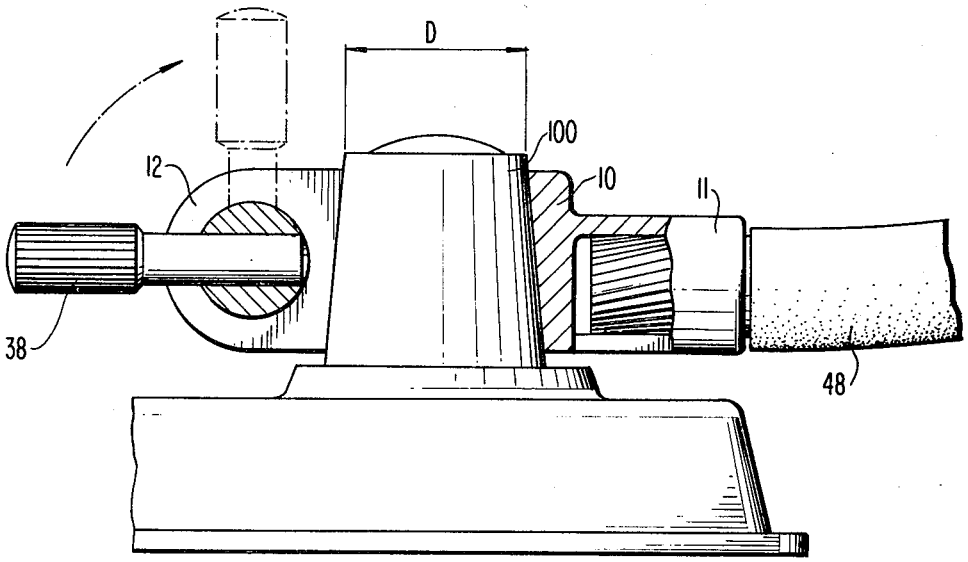
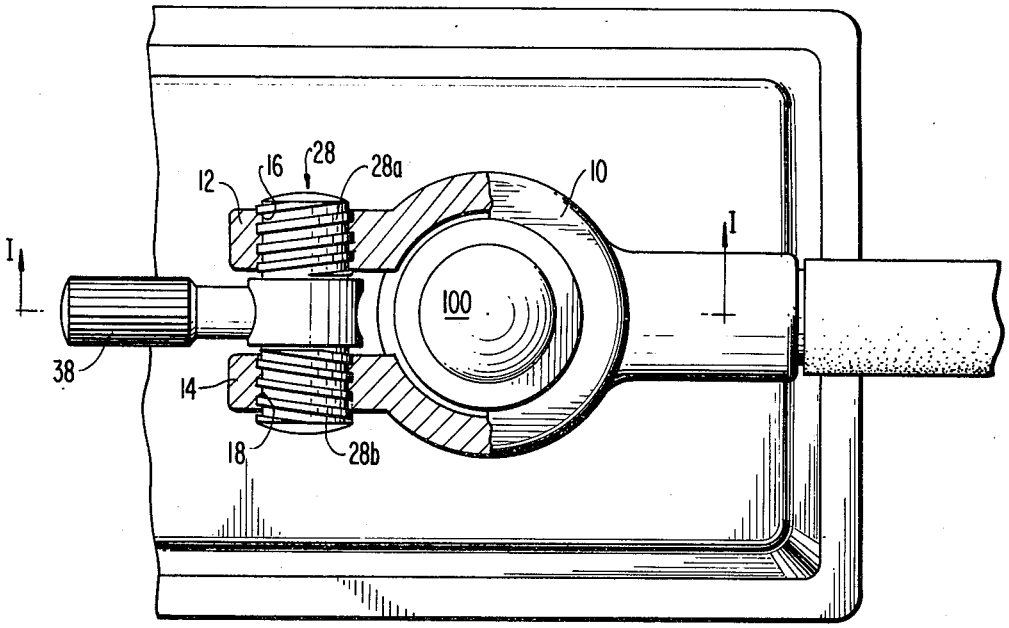
FIG. 2
PRIOR ART

FIG. 3a
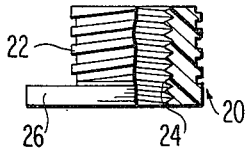
FIG. 3b
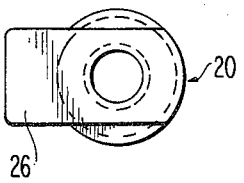
FIG. 4a
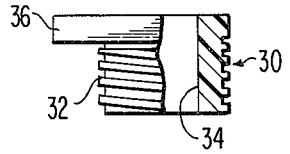
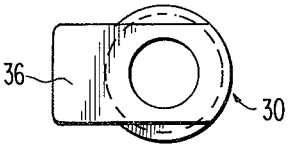
FIG. 4b
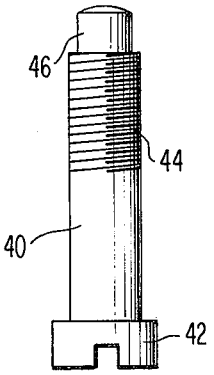
FIG. 5
FIG. 6
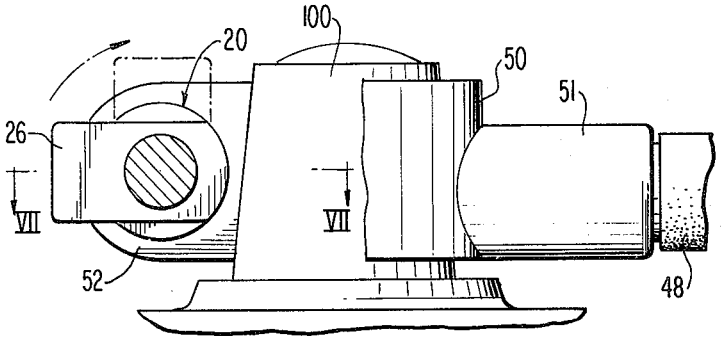
FIG. 7
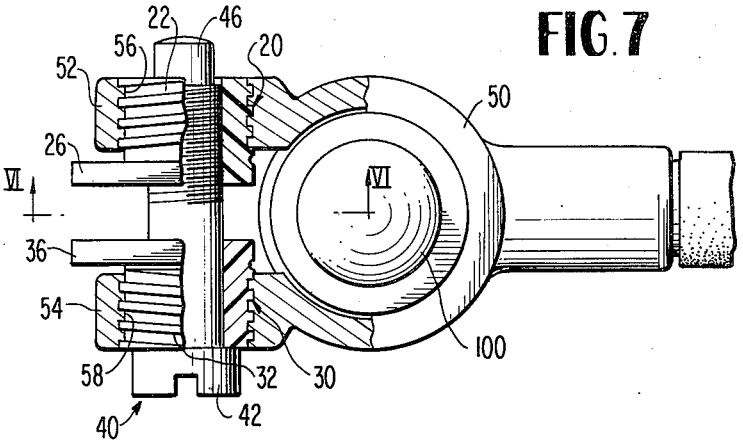
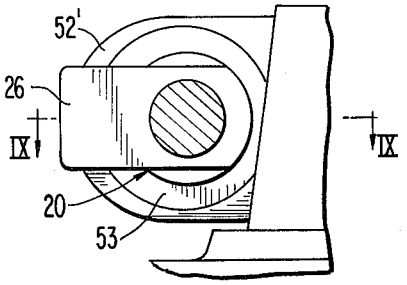
FIG. 8
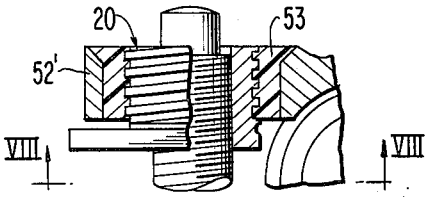
FIG. 9

FIG.10
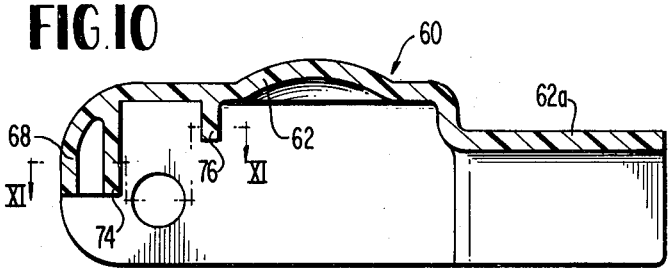
FIG.11
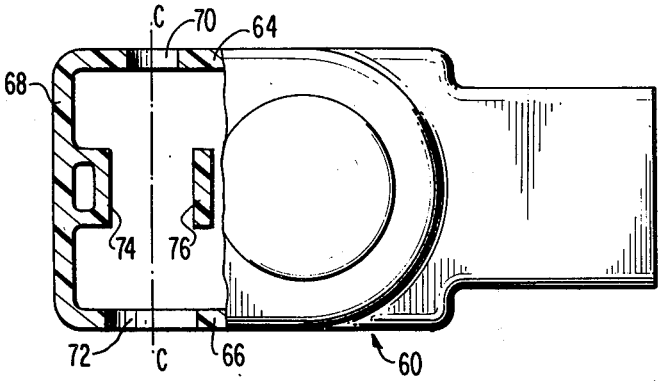
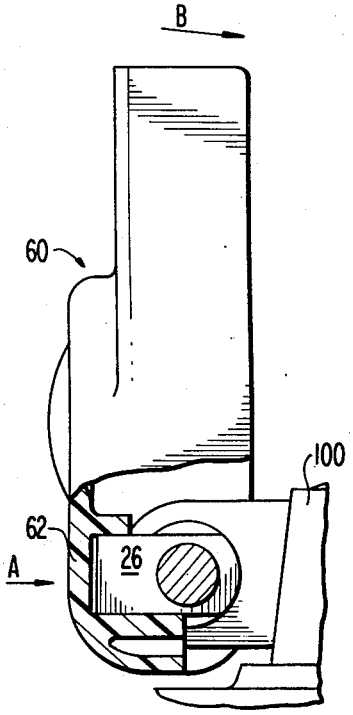
FIG.12
FIG.13
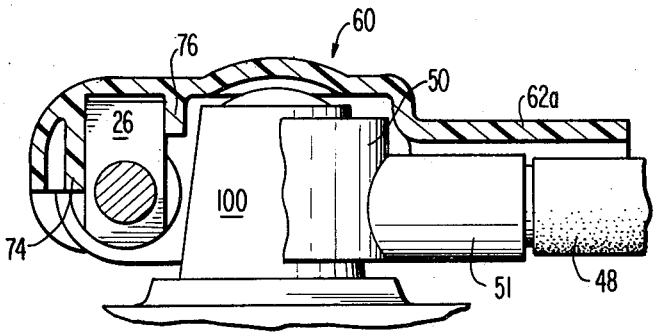
FIG.14
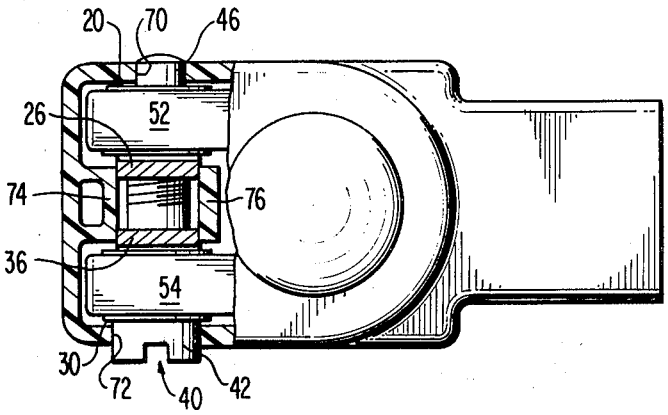

FIG.17
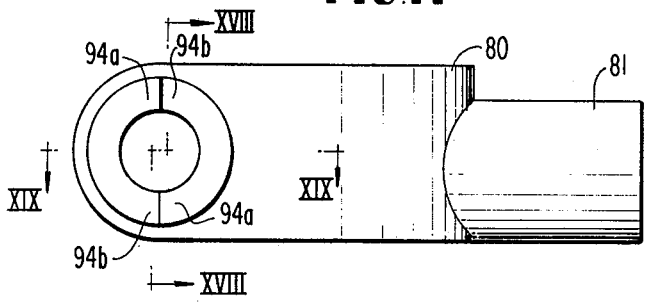
FIG.18
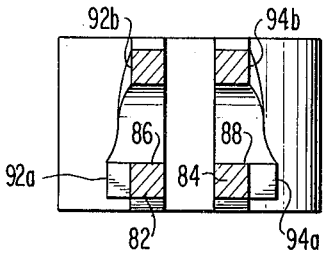
FIG.19
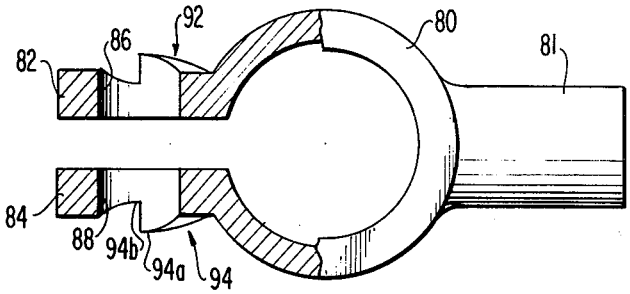
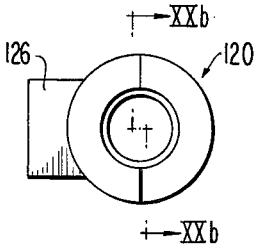
FIG.20a
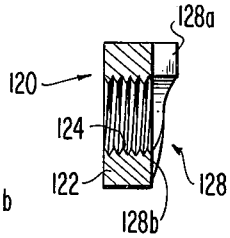
FIG.20b
FIG.22
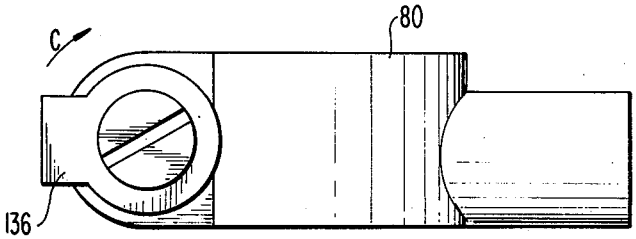
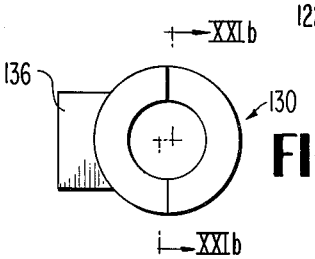
FIG.21a
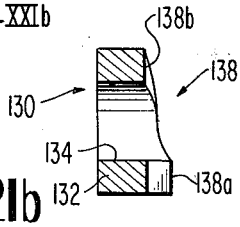
FIG.21b
FIG.24
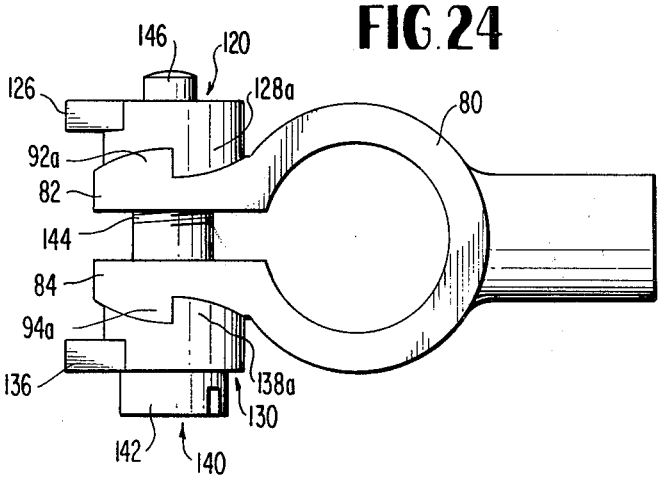
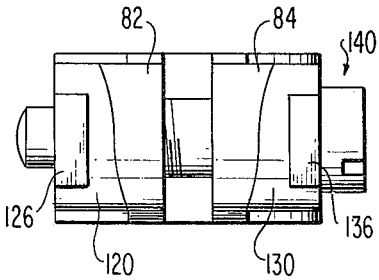
FIG.23

TERMINAL POST CONNECTION ESPECIALLY FOR STORAGE BATTERIES

The present invention relates to connecting devices for electric cables, and especially relates to such a device, of the clamp type, for connection of cables to the terminal posts of a storage battery.

The conventional storage battery, such as is used as a starter battery for an automobile, generally is a lead-acid battery and has its electric terminals formed as tapered pins or "bolts" of standardized dimension made of lead or a lead alloy. The battery cables are connected in the simplest mechanical way, in that an annular stirrup fixed on the respective cable ends, comprising two arms or jaws of leaded brass or metal protected in some other way against corrosion, is slid onto the terminal post. The free ends of the stirrup arms are joined by a bolt that passes through the passage in the ends of the arms and has a nut threaded onto its end, which after the stirrup is put in position, is tightened so that the arms clamp or tightly grip around the terminal post.

It is well known that this practically universal type of cable connection has great drawbacks, in spite of its generally robust nature and its mechanical simplicity, primarily because the relatively soft terminal post is so readily deformed by the tightening of the stirrup, which is done with considerable force, e.g., the nut is tightened by means of a wrench or similar tool, whereby the tightening forces are not so easily moderated. Furthermore, the whole post connection is open, lying bare, which is a factor that entails the risk of short circuiting unless special protective caps or insulating sleeves are used, which is seldom the case.

The invention thus has as its object to provide a novel type of electric terminal post connection, especially intended to replace the above described battery cable connection, and which is a fast coupling type.

Another object is to provide an improved connector arrangement where with a simple manual grip without the use of a tool, a battery terminal can be quickly connected or disconnected from the terminal post of a battery. In its connected position, the connector and terminal are covered to be insulated from the environment so that the risk of short circuit and subsequent dangerous sparking is eliminated as far as possible.

These and other objects of the invention will become more fully apparent from the claims, and from the description when read in conjunction with the appended drawings wherein:

FIGS. 1 and 2 are respectively a side view and a plan view, partly in section, of a known terminal clamp for connection to the terminal post of a battery, whereby the clamp is provided with a maneuvering device for fixing it on the terminal post:

FIG. 3*a* is a plan view partly in section of a maneuvering sleeve for a post connection device according to the invention;

FIG. 3*b* is a side view of the sleeve of FIG. 3*a;*

FIGS. 4*a* and 4*b* are views similar to FIGS. 3*a* and 3*b*, respectively, and show a second maneuvering sleeve included in the post connection;

FIG. 5 shows a holding spindle bolt of the connection device;

FIG. 6 is a side view, partly in section, along line VI—VI of FIG. 7, of a connection device disposed on the terminal post of a storage battery in accord with the present invention;

FIG. 7 is a plan view of the connection device of FIG. 6, partly in section, along line VII—VII;

FIG. 8 is a side view similar to FIG. 6, but modified to show the use of a threaded insert;

FIG. 9 is a partial plan view taken along line IX—IX of FIG. 8;

FIG. 10 is a side elevation of a combined maneuvering and protecting cap of the connection device of the invention;

FIG. 11 is a plan view of the cap, partly in section, along line XI—XI of FIG. 10;

FIG. 12 is a partial side elevation, partly in section, showing how the cap illustrated in FIGS. 10 and 11 is in a position allowing connecting devices to be attached to a terminal post;

FIG. 13 is a view similar to FIG. 12, but of a larger part of the connecting device shown in its normal installed position;

FIG. 14 is a plan view, in partial section, of the device shown in FIG. 13;

FIG. 17 is a side view of a clamping stirrup of the connection device of the invention in a modified form;

FIG. 18 is a front view of the stirrup, partly in section, along line XVIII—XVIII of FIG. 17;

FIG. 19 is a plan view of the stirrup, partly in section, along line XIX—XIX of FIG. 17;

Figure 15:
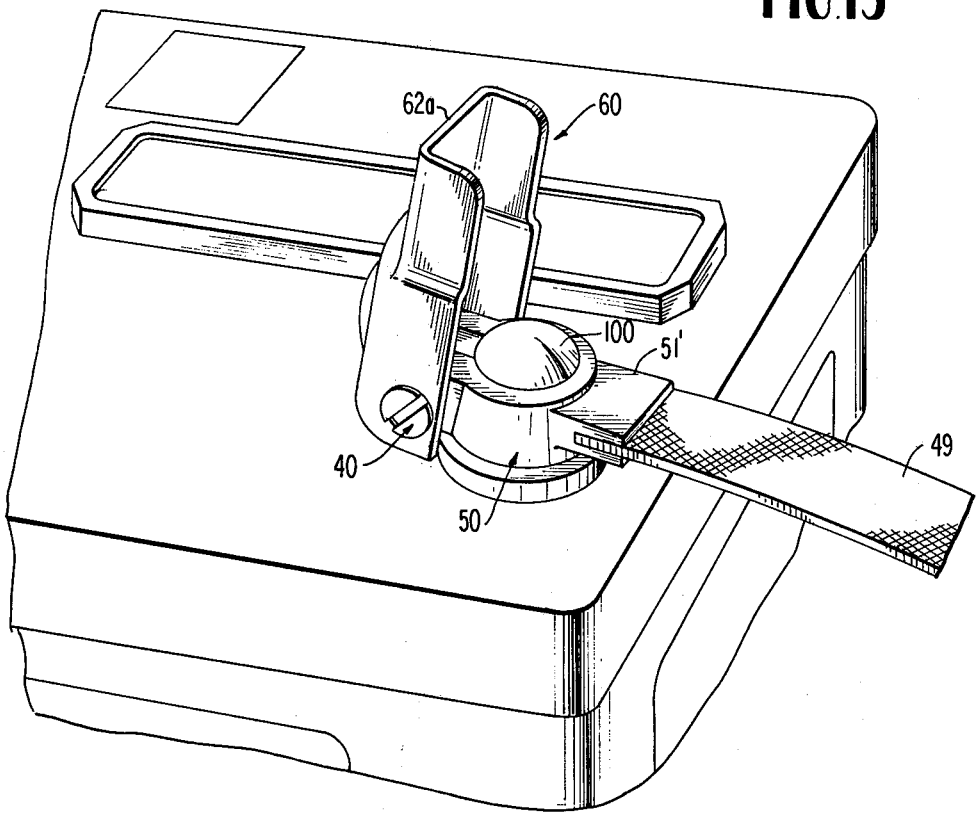
FIG. 15 is a pictorial view of a battery terminal and connection device of the invention arranged at the end of a ground cable and slid onto the terminal post of the storage battery before the final fixing of the device on the post.

FIG. 20*a* shows a first cam element of the modified form of the connection device as shown in FIGS. 17–19;

FIG. 20*b* is a section along line XX*b*—XX*b* of FIG. 20*a;* and

FIG. 21*a* is a view corresponding to FIG. 20*a* and shows a second cam element of the same connection device;

FIG. 21*b* is a section along line XX1*b*—XX1*b* of FIG. 21*a;*

FIGS. 22, 23, and 24 are a side, front, and plan view, respectively, of the modified device of the invention, with the appurtenant maneuvering and protective cover removed.

To illustrate the background of the invention, there is by way of introduction (see FIGS. 1 and 2), an illustration of a prior art type of connection that can be effected between a strong current conducting cable, e.g., of an automobile starter battery, and the terminal of a storage battery. In the drawings, there is schematically shown a part of the top side of a storage battery with a terminal or terminal post 100, usually made of lead and with standardized dimensions, including a specific taper and a specific minimum diameter D, these being different for the positive and negative poles. Post 100 is surrounded by a stirrup 10 made of a suitable material such as leaded brass. The stirrup customarily has two projecting parallel lugs or arms 12, 14 and is fixedly joined with a battery cable 48, as for example by means of a known bolt connection or, as here illustrated, by being firmly anchored in a sleeve part 11 projecting from stirrup 10, pressed around the cable end.

Stirrup 10 grips around terminal post 100 because its projecting arms or lugs 12 and 14 are turned toward each other. This joining is most often effected, as is known, in such a way that a screw or bolt is taken through a hole in the arms, whereafter it is tightened by a nut set on the bolt. According to FIGS. 1 and 2, on the contrary, it is assumed that the opposing action is effected by means of a double threaded bolt or spindle 28 which has a right-hand threaded end part 28*a* and a left-hand threaded part 28*b*, by and large as disclosed in Swedish Pat. No. 80,626. The threaded parts are received in the correspondingly threaded holes 16 and 18 in the respective stirrup arms 12 and 14, see FIG. 2. In this case, maneuvering pin 38 is introduced into the central part of spindle 28, and by means of said pin, the arms of the stirrup are moved toward or away from each other. If, therefore, stirrup 10 is slid onto terminal post 100 with pin 38 in the position illustrated in FIG. 1 and the pin is then turned 90° to the position indicated by dashed lines, arms 12 and 14 will be drawn toward each other and terminal post 100 will form a permanent clamped unit with stirrup 10.

The above-identified construction gives a strong clamping effect, but it has the drawback that it lacks the possibility of pre- or post-adjustment. A 90° swing of pin 38 imparts a quite insignificant movement to arms 12 and 14 of the stirrup, and in consideration of the facts that diameter D in a certain terminal post type may vary substantially because of allowed manufacturing tolerances and that there is wear in the course of operation, it is practically impossible to get a satisfactory permanent clamping action by stirrup 10 on terminal post 100 except at a certain dimensional relationship. If the dimensional relationships change, a 90° swing of pin 38 will not be sufficient for providing the necessary clamping effect.

According to the invention, this drawback may be alleviated by replacing the said maneuvering spindle 28 and pin 38 with a maneuvering system having a "primary adjustment" that is described in more detail below. FIGS. 3 and 4 show sleeves 20 and 30, respectively, which may be of metal or high strength synthetic resin such as polypropylene. The sleeves 20 and 30 are externally threaded with opposite threading, so that sleeve 20 has an external right-hand thread 22, while sleeve 30 has an external left-hand thread 32, preferably with the same pitch as thread 22. Sleeve 20 has an internal thread 24 that goes all the way through the whole sleeve, while sleeve 30 has an internal free passage 34.

Referring to FIG. 5, the central openings of the sleeves are intended to receive a stainless steel bolt 40, the shank of which is provided with a thread 44 that matches internal thread 24 of sleeve 20. Bolt 40 has a slotted head 42, and its opposite end is machined down to form a guide stud 46. Both sleeves 20 and 30 are formed at their ends with projecting maneuvering arms 26 and 36, respectively, see FIGS. 3 and 4. The sleeves are connected to each other by means of bolt 40, which is introduced through passage 34 of sleeve 30 and screwed into thread 24 of sleeve 20, whereby arms 26 and 36 of the sleeves are turned toward each other in this case.

The assembly thus constituted corresponds to maneuvering device 28, 38 of FIGS. 1 and 2, and in FIGS. 6 and 7 this assembly which consists of sleeves 20 and 30 and bolt 40, is shown mounted in a stirrup 50. This corresponds wholly to stirrup 10 and presents projecting lugs or arms 52 and 54 with passages 56 and 58, respectively, which are internally threaded, whereof the former is a right-hand thread and the latter is a left-hand thread. As before, stirrup 50 has a sleeve part 51 opposite the arms, for pressing the battery cable 48.

A comparison of FIGS. 6, 7 with FIGS. 1, 2 immediately shows that the sleeves-bolt assembly 20, 30, 40 as a whole has exactly the same effect as spindle 28 and maneuvering pins 38. If arms 26 and 36 of the sleeves are swung by 90° as indicated in FIG. 6, arms 52 and 54 of the stirrup will be brought toward each other and stirrup 50 will be clamped about terminal post 100. In this case, however, the arms can also be pulled together by means of bolt spindle 40, as is clear from FIG. 7. If arms 26 and 36 are held stationary and bolt spindle 40 is turned in the tightening direction with bolt head 42 engaging sleeve 30, sleeve 20 will be pulled toward sleeve 30, and thereby arm 52 will be moved toward arm 54. By means of bolt spindle 40, therefore, there can be a basic setting or presetting with arms 26 and 36 in the illustrated position, so that the stirrup with slight slide fitting can be introduced onto terminal post 100 without working loose. When the arms 26 and 36 are moved up by 90°, there is an anchoring, in that the stirrup arms are pulled toward each other by screw engagement between the sleeves and the arms. This latter pulling together by the action of the screw threads is thus superimposed upon the turning adjustment of bolt spindle 40, and is designated "primary setting," as above.

In this way, there is a simple possibility of adjusting the clamping action at any time. If the terminal post becomes worn after a period of use, or if there is a loosening in the maneuvering threads so that the "grip" in the swing of the maneuvering arms is not satisfactory, the clamping action then can be set to full strength by a small turning adjustment of bolt 40.

The respective right-hand and left-hand threaded holes in the arms of the clamping stirrup does not need to be made directly in the material of the arm, but rather if it is desirable for practical reasons, threaded liners may be set in the stirrup arms, e.g., as illustrated in FIGS. 8 and 9. In this case, a sleeve arm 52' is provided with a pressed-in liner 53, of a suitable synthetic resin material in which there are threads, right-handed on this side, for sleeve 20. The stirrup arm may also be given seats of suitable configuration to receive loose plastic liners.

According to the invention, there is associated with the above-described terminal post a combination protective and maneuvering cap 60 which may have the form as illustrated in FIGS. 10–14. Cap 60 itself, see also FIGS. 10 and 11, may be made as a recess intended to receive and cover the complete assembly shown in FIGS. 6 and 7, which thus consists of a clamping stirrup 50–58 seated on terminal post 100 with maneuvering sleeves 20 and 30 and spindle bolt 40, all in conformity with the above description. The cap 60 is open at the bottom and at the back, and comprises a top piece or upper part 62, side walls 64 and 66, and a front wall 68 with a height that is less than that of the side walls. Upper part 62 extends backward, i.e., to the right in the drawings, with an end part 62a, and at the end thereof, the cap 60 is by and large entirely open.

For a purpose that will immediately be evident, there are two opposed openings 70 and 72, the latter with a larger diameter than the former, right in front of it in the respective side walls 64 and 66, near the front end of the cap, on the left according to the drawings. In this part of the cap 60, there are two central spurs 74 and 76, projecting downward from upper part 62, whereof the former spur 74 is near the forward end of the cap and extends downwardly to the level of the lower edge of front wall 68, see FIG. 10, while the second spur 76 is not so high and is disposed, see FIGS. 10 and 11, right in front of spur 74, a little to the inside of it. Seen in plan view, the spurs are equidistant on either side of a center line C—C through openings 70 and 72, see FIG. 11.

The cap is applied by unscrewing spindle bolt 40 from the clamping assembly which then consists only of stirrup 50, in whose arms 52 and 54 the respective sleeves 20 and 30 are screwed, whereafter the cap is slid on so that arms 26 and 36 slip in between spurs 74 and 76. If the arms hereby are horizontally disposed, as in FIGS. 6 and 7, the cap is placed in the direction of arrow A in FIG. 12 while being held in a vertical position. As the last mentioned Figure shows, the cap 60 is pushed until the ends of arms 26 and 36 reach the underside of upper part 62 of the cap, whereby openings 70 and 72 in the cap are coaxial with passage opening 34 and the threaded opening 24 in the respective sleeves 30 and 20, as in FIGS. 3 and 4. Spindle bolt 40 is applied, whereby it is screwed into sleeve 20 and as FIG. 14 shows, its head 42 is received in opening 72 of the cap while its machined end stud 46 is received in opening 70. If the complete assembly is now slid down on terminal post 100 in the position of FIG. 12 and the cap is then let down to the direction of arrow B, arms 26 and 36 go along in this movement, and as indicated above, clamping stirrup 50 hereby grips around the terminal post at the same time that the cap assumes a position that covers and protects the whole assembly, see FIGS. 13, 14 and 16. To loosen and detach the clamp, the cable and protective cap from the terminal post, it is only necessary to tip up the cap, see FIG. 15, by grasping its rear edge at the end part 62*a* of the upper part. To have a fixed contact connection again, the assembly is placed on the terminal post and the cap is lowered, see FIG. 16.

When the terminal clamp of the invention is applied for the first time on a storage battery terminal post, a basic setting is made to fit the clamp to the actual terminal post, by turning of bolt spindle 40 (whose head 42 is readily accessible from the outside of cap 60, see for example FIG. 15) and the clamp arms are introduced in a position such that the clamp goes moderately rigidly down on the terminal post, approximately to the position shown in FIG. 6. Any looseness is then compensated, and anchoring occurs when the cap is lowered. Spindle or bolt 40 thus forms, on the one hand, a fixed but adjustable connection between sleeves 20 and 30, and on the other hand, at the same time it constitutes a holder and fastening for cap 60 and a shaft for its maneuvering movement. The said adjustable connection or primary setting also affords, as has been noted, the possibility that the clamping effect of the connection device may be very simply reset to its full force. If, in the course of time, it deteriorates because of loosening from wear or deformation, a little turn of bolt 40 is sufficient for this purpose.

Figure 16:
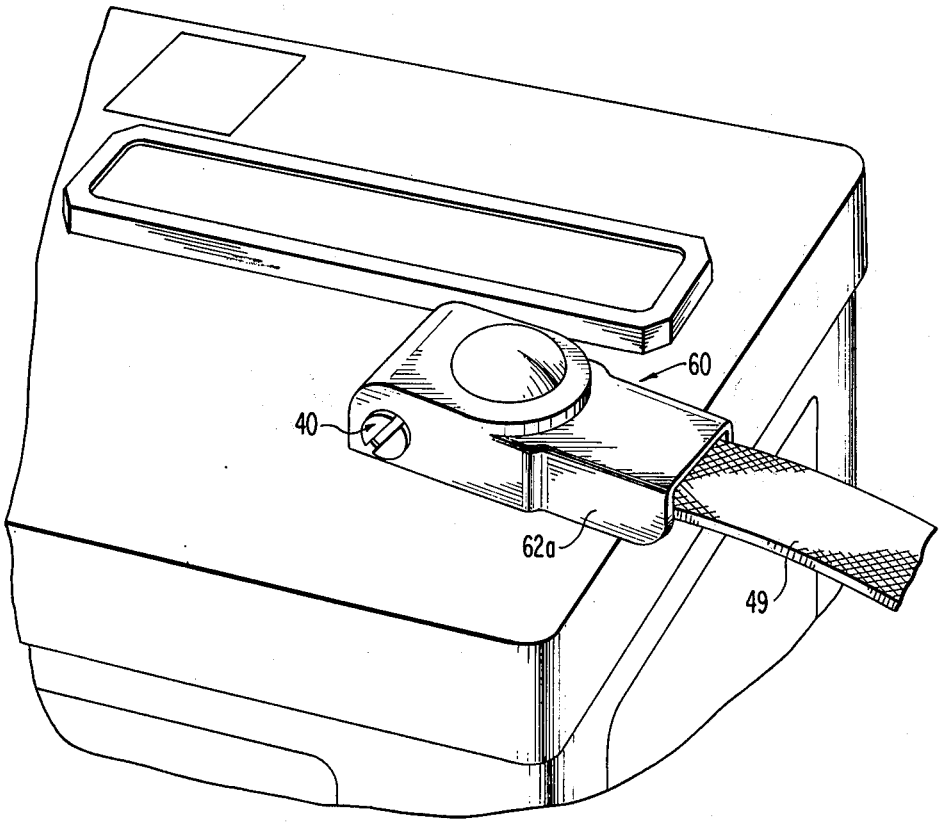
FIG. 16 is a view corresponding to FIG. 15, but showing the connection fixed and locked in its working position on the post.

FIGS. 15 and 16 show how cap 60 is maniupated on a cable connection 51' of stirrup 50 which is fastened to a flat braided ground cable 49 of conventional type. It is noted in this respect that the clamping stirrup of the connection device of the invention obviously may be provided with any suitable connector of known type for clamping of a cable end.

The described combined protective and maneuvering cap may also be connected with the maneuvering sleeves in another way, if for some reason it should be inappropriate to provide sleeves with protruding arms. In such a case, the sleeves may be made with "sockets," wrench grip surfaces or other gripping element to engage a mating construction formed in the cap when the cap is slid on the connecting device.

In FIGS. 17–24, a second embodiment of the terminal post clamp of the invention is shown, which corresponds in principle with the first embodiment but differs from it in the means for effecting movement of the clamp. In summary, it can be said that in the second embodiment, the clamp stirrup arms are moved by camming, as opposed to the situation in the first embodiment where the movement of the arms is effected, of course, by means of a threaded bolt movement.

The second embodiment thus comprises a clamp stirrup 80 with projecting arms 82 and 84, both of which have passage openings 86 and 88, respectively, which passages are coaxial. As before, the stirrup opposite the arms is provided with a suitable cable connection 81. On their outsides, the arms are made with their respective cam formation 92 and 94 presenting camming surfaces in the form of two half-flat grooves mutually displaced by 180°. If we consider arm 84, see FIGS. 17–19, we see that it thus presents on its outside a cam formation 94 consisting of two half-flat grooves, each extending over 180°. The groove halves present their highest point 94*a* and lowest point 94*b*. As the drawings show, opposite arm 82 is provided with a cam formation 92 disposed in exactly the same way, constituting a mirror image of the first mentioned arm.

The threaded maneuvering sleeves that have been previously described have their counterparts in this embodiment in two camming elements or cam sleeves 120 (FIGS. 20*a*, 20*b*) and 130 (FIGS. 21*a*, 21*b*), provided with radially projecting arms 126 and 136, respectively: their dimensions correspond to those of the earlier cams 26 and 36 (see FIGS. 3 and 4). On the opposed ends of arms 126 and 136, there are cam formations 128 and 138, respectively, which correspond to and adapt to cam formations 92 and 94, respectively, on the outsides of stirrup arms 82 and 84, respectively. If we consider cam sleeve 120, for instance, it appears from FIGS. 20*a* and 20*b* that it comprises a sleeve 122 with a central internally threaded passage 124. Sleeve 122, on its end that is opposite arm 126, is formed with the said cam formation 128, made by two half-flat grooves with highest points 128*a* and lowest points 128*b*. The cam sleeve 130 is analogously formed, so that the cam surfaces on its cam formation 138 at the end of its sleeve part 132 (which has a central free passage 134) is a mirror image of the cam surfaces on the first sleeve 120.

When the two cam sleeves are applied against the outside of arms 82 and 84 of stirrup 80 with their appurtenant cam surfaces in full mutual engagement, the parts assume the relative position illustrated in FIGS. 22–24. As mentioned above, sleeve 120 (see FIGS. 20 and 21), has a central threaded hole 124 while sleeve 130 has a central free passage 134. Thus, the cam sleeves can be applied against the outsides of the stirrup arms when a spindle bolt 140 (which is essentially like the previously described spindle bolt 40 with a head 142, shank thread 144, and end tap 146) is introduced through free passage 134 of sleeve 130, further through passages 86 and 88, respectively, of arms 82 and 84, and is engaged in threaded hole 124 in cam sleeve 120. As shown by FIGS. 22–24, arms 126 and 136 of the cam sleeves come into position, i.e., with cooperating cam surfaces in full engagement, to slide horizontally outward in the long direction of the stirrup. It is apparent from the drawings that if the arms are moved upward in the direction of arrow C (see FIG. 22), the stirrup arms will be clamped together because the mutually held cam sleeve cams will ride up one of the cams of the stirrup arms and slide them inward. The clamping action is thus the same as in the earlier embodiment, where the arms are screwed toward each other by the 90° turning of the threaded maneuvering sleeve by means of its maneuvering arms.

For maneuvering, use is made of a covering and protecting cap of a configuration that in principle is similar to that of cap 60 of FIGS. 10–14. One difference is that the last-mentioned cap's centrally disposed gripping spurs 74 and 76 are replaced by two pairs of corresponding spurs arranged on the inside of side walls 64 and 66 of the cap above openings 70 and 72, respectively, since arms 126 and 136 of sleeves 120 and 130 in this case are disposed on the outside of the arms of the clamping stirrup, and not between them. In this case, also, the clamping of the stirrup is effected by tipping the cap down over the stirrup slid onto the terminal post to its protective position shown in FIG. 16. It is noted, also, that the first described embodiment with screw sleeves can obviously be arranged with the arms 26 and 36 on the outside of respective arms 52 and 54.

The present invention may be embodied in other specific forms without departing from the spirit or essential characteristics thereof. The presently disclosed embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and intended to be covered by Letters Patent is:

1. Terminal connection apparatus for detachably connecting an electric cable to a terminal post comprising:

a stirrup joined with said cable and having spaced arms arranged to surround the sides of said terminal post; and a clamping device located at free ends of the arms and arranged to engage with said free arm ends adapted to be located on opposite sides of said terminal post, said clamping device being placed under tension to press said arms toward each other to a locking position;

said clamping device comprising a first clamp element including a threaded member adapted for rotational movement relative to said arms to adjust the position between the ends of the arms and a second clamp element including a pair of externally threaded coaxial sleeves which are mounted on the threaded member and threadedly engage internal threaded bores in respective stirrup arms, said sleeves having radially projecting maneuvering arms for advancing said sleeves into or out of the respective stirrup arms, and the threads of one sleeve have a pitch opposite to that of the other sleeve.

2. Terminal connection apparatus as defined in claim 1 further including a protective cap that encloses and insulates the connection apparatus and is formed to be detachably joined to the maneuvering arms to thereby form a hand grip for effecting the turning movement of the sleeves.

3. Terminal connection apparatus as defined in claim 1, wherein the stirrup arms include separate internally threaded liners for engaging the external threads on said sleeves.

4. Terminal connection apparatus for detachably connecting an electric cable to a terminal post comprising:

a stirrup joined with said cable and having spaced arms arranged to surround the sides of said terminal post; and a clamping device located at free ends of the arms and arranged to engage with said free arm ends adapted to be located on opposite sides of said terminal post, said clamping device being placed under tension to press said arms toward each other to a locking position;

said clamping device comprising a first clamp element including a threaded member adapted for rotational movement relative to said arms to adjust the position between the ends of the arms and a second clamp element including a pair of sleeves each having cam surfaces near the outer ends of the stirrup arms, said sleeves being mounted on the threaded member for coaxial rotational movement, and said second clamp element further comprising maneuvering arms that project substantially radially from the cam sleeves whereby contact surfaces on the stirrup arm ends and the cam elements that face each other serve as camming formations in mutual engagement that cooperate in such a way that the stirrup arm ends disposed between the cam surfaces are pressed toward each other when the maneuvering arms are turned.

5. Terminal connection apparatus as defined in claim 4 further including a protective cap that encloses and insulates the connection apparatus and is formed to be detachably joined to the maneuvering arms to thereby form a hand grip for effecting the turning movement of the sleeves.

* * * * *